US009699570B2

(12) United States Patent
Tu et al.

(10) Patent No.: US 9,699,570 B2
(45) Date of Patent: Jul. 4, 2017

(54) VOICE SIGNAL PROCESSING APPARATUS AND VOICE SIGNAL PROCESSING METHOD

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 86 days.

(21) Appl. No.: 14/804,355

(22) Filed: Jul. 21, 2015

(65) Prior Publication Data

US 2016/0360324 A1 Dec. 8, 2016

(30) Foreign Application Priority Data

Jun. 5, 2015 (TW) ..... 104118328 A

(51) Int. Cl.

| | |
|---|---|
| ***G10L 21/00*** | (2013.01) |
| ***H04R 25/00*** | (2006.01) |
| ***G10L 21/02*** | (2013.01) |
| *G10L 21/057* | (2013.01) |

(52) U.S. Cl.

CPC ..... *H04R 25/353* (2013.01); *G10L 21/0202* (2013.01); *G10L 21/057* (2013.01); *H04R 2225/43* (2013.01)

(58) Field of Classification Search

None

See application file for complete search history.

(56) References Cited

U.S. PATENT DOCUMENTS

| | | | | |
|---|---|---|---|---|
| 9,165,561 | B2 * | 10/2015 | Wu | G10L 19/018 |
| 2015/0049879 | A1 * | 2/2015 | Young | H04R 3/04 381/98 |
| 2016/0210987 | A1 * | 7/2016 | Sugiyama | G10L 21/0232 |
| 2016/0217805 | A1 * | 7/2016 | Tu | G10L 21/0202 |
| 2016/0343388 | A1 * | 11/2016 | Tu | G10L 25/18 |

* cited by examiner

*Primary Examiner* — Satwant Singh

(74) *Attorney, Agent, or Firm* — Jianq Chyun IP Office

(57) ABSTRACT

A voice signal processing apparatus and a voice signal processing method are provided. A last sampling point of an $m^{th}$ original frequency-lowered signal frame is determined according to a phase reference sampling point number of the $m^{th}$ original frequency-lowered signal frame. Here, the phase reference sampling point number corresponds to a middle sampling point of an $m^{th}$ renovating frequency-lowered signal frame, and the last sampling point is phase-matched with a sampling point corresponding to the phase reference sampling point number in the $m^{th}$ original frequency-lowered signal frame. P consecutive sampling points starting from the last sampling point are applied as sampling points of an $(m+1)^{th}$ renovating frequency-lowered signal frame.

12 Claims, 4 Drawing Sheets

VOICE SIGNAL PROCESSING APPARATUS AND VOICE SIGNAL PROCESSING METHOD

CROSS-REFERENCE TO RELATED APPLICATION

This application claims the priority benefit of Taiwan application serial no. 104118328, filed on Jun. 5, 2015. The entirety of the above-mentioned patent application is hereby incorporated by reference herein and made a part of this specification.

BACKGROUND OF THE INVENTION

Field of the Invention

The invention relates to a signal processing apparatus; more particularly, the invention relates to a video signal processing apparatus and a voice signal processing method.

Description of Related Art

In general, hearing-impaired people can clearly hear low frequency signals but have trouble receiving high frequency voice signals (e.g., a consonant signal). According to the related art, such an issue is generally resolved by lowering a frequency of the high frequency signal and stacking signal frames. However, in the conventional process of stacking the signal frames, whether the phases of the signal frames are matched with each other is usually not taken into consideration. Therefore, in the overlapped signal frames, parts of the signals may be added up while other parts of the signals may be offset, which may further cause signal distortion.

SUMMARY OF THE INVENTION

The invention is directed to a voice signal processing apparatus and a voice signal processing method. Thereby, while signal frames are overlapped, the issue of signal distortion caused by phase mismatch can be effectively resolved.

In an embodiment of the invention, a voice signal processing apparatus includes a processing unit which is configured to lower a frequency of a sampling voice signal to generate a frequency-lowered signal including a sequence of original frequency-lowered signal frames and generate corresponding renovating frequency-lowered signal frames according to the original frequency-lowered signal frames. Here, each of the original frequency-lowered signal frames includes p sampling points. The processing unit further determines a last sampling point of an $m^{th}$ original frequency-lowered signal frame phase-matched with the sampling point corresponding to a phase reference sampling point number according to the phase reference sampling point number of the $m^{th}$ original frequency-lowered signal frame corresponding to a middle sampling point of an $m^{th}$ renovating frequency-lowered signal frame of the renovating frequency-lowered signal frames. The processing unit also applies P consecutive sampling points starting from the last sampling point phase-matched with the sampling point corresponding to the phase reference sampling point number as the sampling points of an $(m+1)^{th}$ renovating frequency-lowered signal frame, and adjacent renovating frequency-lowered signal frames of the renovating frequency-lowered signal frames are mixed and stacked to generate an overlapping voice signal. Here, p is a positive integer, and m is a positive integer greater than 1.

According to an embodiment of the invention, each of two adjacent renovating frequency-lowered signal frames includes a 50% overlapping section.

According to an embodiment of the invention, the processing unit further adds up a first count value and a second count value according to sampling values of the sampling points of the $m^{th}$ original frequency-lowered signal frame. Here, when the frequency-lowered signal in a positive half cycle is changed to a negative half cycle, the processing unit returns the first count value to 0, and when the frequency-lowered signal in the negative half cycle is changed to the positive half cycle, the processing unit returns the second count value to 0. The processing unit applies the first count value or the second count value corresponding to the sampling point of the $m^{th}$ original frequency-lowered signal frame corresponding to the phase reference sampling point number as a reference value, and the processing unit determines the last sampling point of the $m^{th}$ original frequency-lowered signal frame phase-matched with the sampling point corresponding to the phase reference sampling point number according to the reference value.

According to an embodiment of the invention, the processing unit further determines whether the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number. If the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, the processing unit applies the first count value of the $m^{th}$ original frequency-lowered signal frame corresponding to the sampling point corresponding to the phase reference sampling point number as the reference value and applies a last-sampled sampling point of the sampling points of the $m^{th}$ original frequency-lowered signal frame where the first count value is equal to the reference value as the last sampling point of the $m^{th}$ original frequency-lowered signal frame phase-matched with the sampling point corresponding to the phase reference sampling point number; if the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, the processing unit applies the second count value of the $m^{th}$ original frequency-lowered signal frame corresponding to the sampling point corresponding to the phase reference sampling point number as the reference value and applies the last-sampled sampling point of the sampling points of the $m^{th}$ original frequency-lowered signal frame where the second count value is equal to the reference value as the last sampling point of the $m^{th}$ original frequency-lowered signal frame phase-matched with the sampling point corresponding to the phase reference sampling point number.

According to an embodiment of the invention, the processing unit further multiplies the frequency-lowered signal by a Hamming window.

In an embodiment of the invention, a voice signal processing method includes following steps. A frequency of a sampling voice signal is lowered to generate a frequency-lowered signal including a sequence of original frequency-lowered signal frames. Here, each of the original frequency-lowered signal frames includes p sampling points, and p is a positive integer. A last sampling point of an $m^{th}$ original frequency-lowered signal frame is determined according to a phase reference sampling point number of the $m^{th}$ original frequency-lowered signal frame. Here, the phase reference sampling point number corresponds to a middle sampling point of an $m^{th}$ renovating frequency-lowered signal frame, the last sampling point is phase-matched with a sampling point corresponding to the phase reference sampling point number in the $m^{th}$ original frequency-lowered signal frame, and m is a positive integer greater than 1. P consecutive sampling points starting from the last sampling point phase-matched with the sampling point corresponding to the phase reference sampling point number are applied as the sampling points of an $(m+1)^{th}$ renovating frequency-lowered signal frame of the renovating frequency-lowered signal frames. Adjacent renovating frequency-lowered signal frames are mixed and stacked to generate an overlapping voice signal.

According to an embodiment of the invention, each of two adjacent renovating frequency-lowered signal frames includes a 50% overlapping section.

According to an embodiment of the invention, the step of determining the last sampling point of the $m^{th}$ original frequency-lowered signal frame phase-matched with the sampling point corresponding to the phase reference sampling point number according to the phase reference sampling point number corresponding to the middle sampling point of the $m^{th}$ renovating frequency-lowered signal frame includes following steps. A first count value and a second count value are added up according to sampling values of the sampling points of the $m^{th}$ original frequency-lowered signal frame. When the frequency-lowered signal in a positive half cycle is changed to a negative half cycle, the first count value is returned to 0, and when the frequency-lowered signal in the negative half cycle is changed to the positive half cycle, the second count value is returned to 0. The first count value or the second count value corresponding to the sampling point of the $m^{th}$ original frequency-lowered signal frame corresponding to the phase reference sampling point number is applied as a reference value. The last sampling point of the $m^{th}$ original frequency-lowered signal frame phase-matched with the sampling point corresponding to the phase reference sampling point number is determined according to the reference value.

According to an embodiment of the invention, the step of applying the first count value or the second count value corresponding to the sampling point of the $m^{th}$ original frequency-lowered signal frame corresponding to the phase reference sampling point number as the reference value includes following steps. It is determined whether the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number. If the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, the first count value corresponding to the sampling point of the $m^{th}$ original frequency-lowered signal frame corresponding to the phase reference sampling point number is applied as a reference value. If the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, the second count value corresponding to the sampling point of the $m^{th}$ original frequency-lowered signal frame corresponding to the phase reference sampling point number is applied as a reference value.

According to an embodiment of the invention, if the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, the voice signal processing method further includes applying a last-sampled sampling point of the sampling points of the $m^{th}$ original frequency-lowered signal frame where the first count value is equal to the reference value as the last sampling point of the $m^{th}$ original frequency-lowered signal frame phase-matched with the sampling point corresponding to the phase reference sampling point number.

According to an embodiment of the invention, if the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, the voice signal processing method further includes applying a last-sampled sampling point of the sampling points of the $m^{th}$ original frequency-lowered signal frame where the second count value is equal to the reference value as the last sampling point of the $m^{th}$ original frequency-lowered signal frame phase-matched with the sampling point corresponding to the phase reference sampling point number.

According to an embodiment of the invention, the voice signal processing method includes multiplying the frequency-lowered signal by a Hamming window.

In view of the above, the last sampling point of the $m^{th}$ original frequency-lowered signal frame phase-matched with the sampling point corresponding to the phase reference sampling point number is determined according to the phase reference sampling point number of the $m^{th}$ original frequency-lowered signal frame corresponding to the middle sampling point of the $m^{th}$ renovating frequency-lowered signal frame. The P consecutive sampling points starting from the last sampling point phase-matched with the sampling point corresponding to the phase reference sampling point number is applied as the sampling points of the $(m+1)^{th}$ renovating frequency-lowered signal frame, such that the issue of signal distortion caused by the overlapped signal frames with phase mismatch can be effectively resolved.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
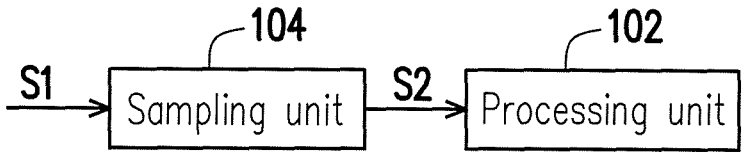
FIG. 1 is a schematic diagram illustrating a video signal processing apparatus according to an embodiment of the invention.

FIG. 1 is a schematic diagram illustrating a video signal processing apparatus according to an embodiment of the invention. Please refer to FIG. 1. The voice signal processing apparatus includes a processing unit 102 and a sampling unit 104, and the processing unit 102 is coupled to the sampling unit 104. Herein, the processing unit 102 may be implemented in form of a central processing unit, for instance; the sampling unit 104 may be implemented in form of a logic circuit, for instance. However, the invention is not limited thereto. The sampling unit 104 is capable of sampling an original voice signal S1 to generate a sampling voice signal S2. The processing unit 102 is capable of lowering a frequency of the sampling voice signal S2 to generate a frequency-lowered signal including a sequence of frequency-lowered signal frames. As shown by the schematic diagram illustrating the processing of the sampling voice signal S2 in FIG. 2, the sampling voice signal S2 may include a sequence of sampling signal frames. In order to clearly describe the invention, only four sampling signal frames W1 to W4 are illustrated according to the embodiment depicted FIG. 2, whereas the invention is not limited thereto. A frequency-lowered signal SL includes a plurality of original frequency-lowered signal frames WL1 to WL4. Since the frequency-lowered signal SL is obtained by lowering the frequency of the sampling voice signal S2, a length of the original frequency-lowered signal frame is greater than a length of the sampling signal frame of the sampling voice signal S2.

Figure 2:
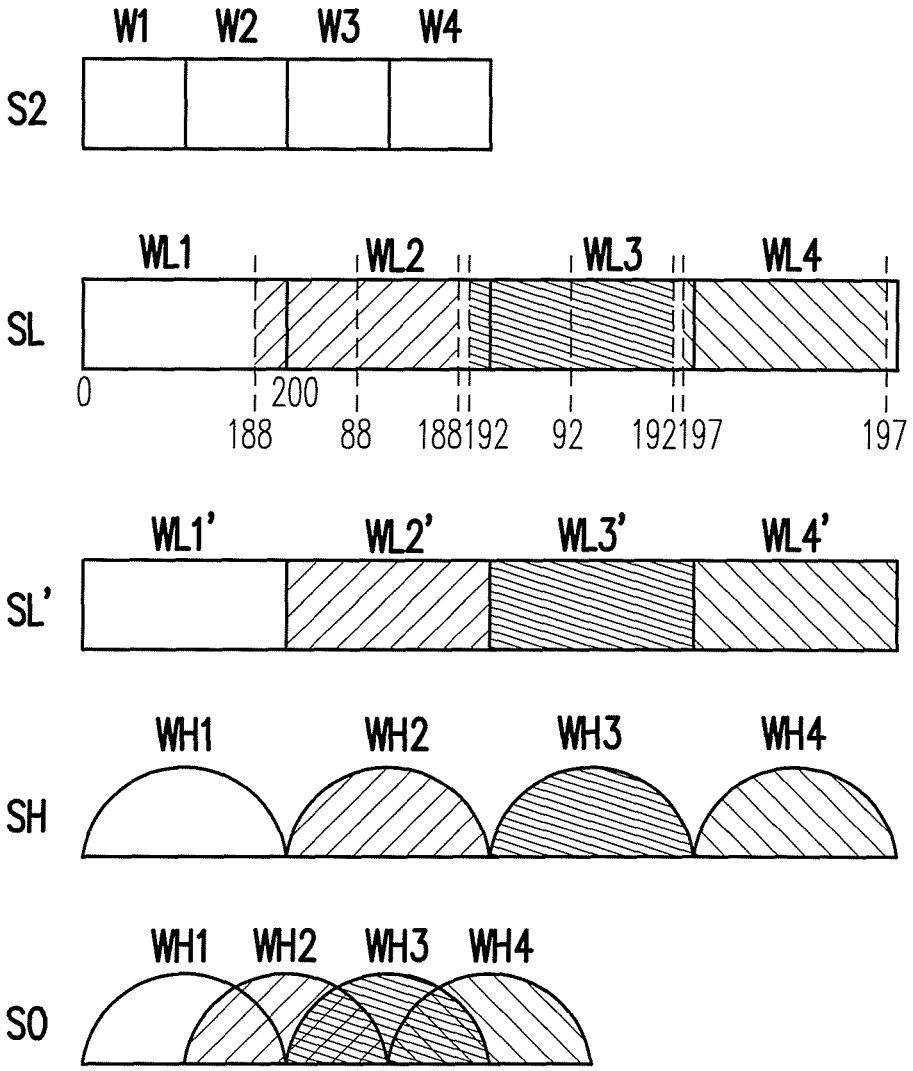
FIG. 2 is a schematic diagram illustrating the processing of a sampling voice signal according to an embodiment of the invention.

The processing unit 102 is able to obtain renovating frequency-lowered signal frames (e.g., renovating frequency-lowered signal frames WL1'-WL4' shown in FIG. 2) by adjusting the sampling points of the original frequency-lowered signal frames, such that the middle sampling point of each renovating frequency-lowered signal frame is phase-matched with the initial sampling point of the next renovating frequency-lowered signal frame, and thereby the issue of signal distortion caused by phase mismatch while the signal frames are overlapped can be resolved.

Each of the original frequency-lowered signal frames includes p sampling points, and p is a positive integer. The processing unit 102 applies the sampling point number of an $m^{th}$ original frequency-lowered signal frame corresponding to a middle sampling point of the $m^{th}$ renovating frequency-lowered signal frame as a phase reference sampling point number, determines the last sampling point of the $m^{th}$ original frequency-lowered signal frame phase-matched with the sampling point corresponding to a phase reference sampling point number according to the phase reference sampling point number, and applies p consecutive sampling points starting from the last sampling point as the sampling points of the $(m+1)^{th}$ renovating frequency-lowered signal frame, such that the middle sampling point of the $m^{th}$ renovating frequency-lowered signal frame is phase-matched with the initial sampling point of the $(m+1)^{th}$ renovating frequency-lowered signal frame. Here, m is a positive integer greater than 1. Accordingly, when a 50% signal frame overlapping action is performed on the $(m+1)^{th}$ renovating frequency-lowered signal frame and the $m^{th}$ renovating frequency-lowered signal frame (i.e., each of the $(m+1)^{th}$ renovating frequency-lowered signal frame and the $m^{th}$ renovating frequency-lowered signal frame includes a 50% overlapping section), the phase mismatch problem may be significantly lessened, and the issue of signal distortion can be resolved to a great extent.

Specifically, the processing unit 102 may add up a first count value and a second count value according to sampling values of the sampling points of the $m^{th}$ original frequency-lowered signal frame. When the frequency-lowered signal SL in a positive half cycle is changed to a negative half cycle, the first count value is returned to 0, and when the frequency-lowered signal SL in the negative half cycle is changed to the positive half cycle, the second count value is returned to 0. The method to add up the first and second count values can be represented by the following formulas (1) to (4).

$$PN_m(n) = \begin{cases} 1, & s_m(n) \geq 0 \\ 0, & s_m(n) < 0 \end{cases} \tag{1}$$

$$PN_m^D(n) = PN_m(n) - PN_m(n-1) \tag{2}$$

$$\mathrm{Cot}_m^+(n) = \begin{cases} 0, & PN_m^D(n) = 1 \\ \mathrm{Cot}_m^+(n-1) + 1, & \text{else} \end{cases} \tag{3}$$

$$\mathrm{Cot}_m^-(n) = \begin{cases} 0, & PN_m^D(n) = -1 \\ \mathrm{Cot}_m^-(n-1) + 1, & \text{else} \end{cases} \tag{4}$$

Here, m is a positive integer greater than 1, n=0, 1, 2, . . . , or 2N−2, N is a positive integer greater than 1, $s_m(n)$ is the sampling value of the sampling point numbered as n in the $m^{th}$ original frequency-lowered signal frame, $PN_m(n)$ serves to convert the sampling value $s_m(n)$ into values represented by "1" or "0", wherein $PN_m(-1)=PN_m(0)$. $\mathrm{Cot}_m^+(n)$ is the first count value corresponding to the sampling point numbered as n in the $m^{th}$ original frequency-lowered signal frame, $\mathrm{Cot}_m^-(n)$ is the second count value corresponding to the sampling point numbered as n in the $m^{th}$ original frequency-lowered signal frame, wherein $\mathrm{Cot}_m^+(-1)=0$, and $\mathrm{Cot}_m^-(-1)=0$. It can be derived from (1) and (2) that $\mathrm{Cot}_m^+(n)$ is an accumulated count value corresponding to the frequency-lowered signal in a positive half cycle, whereas $\mathrm{Cot}_m^-(n)$ is an accumulated count value corresponding to the frequency-lowered signal in a negative half cycle. As shown in formulas (1) to (4), in the present embodiment, the sampling value $s_m(n)$ greater than or equal to 0 and the sampling value $s_m(n)$ less than 0 are set to be 1 and 0, respectively; while the first count value $\mathrm{Cot}_m^+(n)$ is being counted, the first count value corresponding to $PN_m^D(n)$ equal to 1 is returned to 0, and while the second count value $Cot_m^-(n)$ is being counted, the second count value corresponding to $PN_m^D(n)$ equal to −1 is returned to 0.

The processing unit 102 applies the first count value or the second count value corresponding to the sampling point of the $m^{th}$ original frequency-lowered signal frame corresponding to the phase reference sampling point number obtained from the $m^{th}$ renovating frequency-lowered signal frame as a reference value, and the processing unit 102 determines the last sampling point of the $m^{th}$ original frequency-lowered signal frame phase-matched with the sampling point corresponding to the phase reference sampling point number according to the reference value. For instance, the processing unit 102 determines whether the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, which may be represented by the following formula (5):

$$Cot_m^+(n_{Cot_{m-1}}-N+1) \leq Cot_m^-(n_{Cot_{m-1}}-N+1) \quad (5)$$

Here, $n_{Cot_{m-1}}$ is the serial number corresponding to the last sampling point of an $(m-1)^{th}$ original frequency-lowered signal frame phase-matched with the middle sampling point of an $(m-1)^{th}$ renovating frequency-lowered signal frame, and the serial number is equal to the serial number of the sampling point of the $m^{th}$ original frequency-lowered signal frame corresponding to the last sampling point of the $m^{th}$ renovating frequency-lowered signal frame. For instance, as shown in FIG. 2, it is assumed that each of the original frequency-lowered signal frames WL1-WL4 includes 201 sampling points (with the serial numbers 0, 1, 2, . . . , and 200). The serial number of the last sampling point of the original frequency-lowered signal frame WL1 phase-matched with the middle sampling point of the original frequency-lowered signal frame WL1 is 188, and the serial number of the sampling point of the original frequency-lowered signal frame WL2 corresponding to the last sampling point of the renovating frequency-lowered signal frame WL2' is also 188. $n_{Cot_{m-1}}-N+1$ is the phase reference sampling point number of the $m^{th}$ original frequency-lowered signal frame corresponding to the middle sampling point of the $m^{th}$ renovating frequency-lowered signal frame. For instance, as shown in FIG. 2, the sampling point of the original frequency-lowered signal frame WL2 corresponding to the middle sampling point of the renovating frequency-lowered signal frame WL2' is numbered as 88 (i.e., the phase reference sampling point number is 88, and N is 101). $Cot_m^+(n_{Cot_{m-1}}-N+1)$ is the first count value of the $m^{th}$ original frequency-lowered signal frame corresponding to the sampling point corresponding to the phase reference sampling point number, and $Cot_m^-(n_{Cot_{m-1}}-N+1)$ is the second count value of the $m^{th}$ original frequency-lowered signal frame corresponding to the sampling point corresponding to the phase reference sampling point number.

If the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, the processing unit 102 applies the first count value corresponding to the sampling point of the $m^{th}$ original frequency-lowered signal frame corresponding to the phase reference sampling point number as a reference value and applies the last-sampled sampling point of the $m^{th}$ original frequency-lowered signal frame where the first count value is equal to the reference value as the last sampling point of the $m^{th}$ original frequency-lowered signal frame, which can be represented by the following formulas (6) and (7):

$$n_{Cot_m}^+(n) = \begin{cases} n, & Cot_m^+(n) = Cot_m^+(n_{Cot_{m-1}} - N + 1) \\ 0, & \text{else} \end{cases} \quad (6)$$

$$n_{Cot_m} = \text{Max}\{n_{Cot_m}^+(n)\} \quad (7)$$

It can be derived from the formulas (6) and (7) that if the first count value of the $m^{th}$ original frequency-lowered signal frame corresponding to the sampling point with the serial number n is equal to the first count value of the $m^{th}$ original frequency-lowered signal frame corresponding to the phase reference sampling point number, $n_{Cot_m}^+(n)$ equal to the serial number n; if not, $n_{Cot_m}^+(n)$ is equal to 0. $n_{Cot_m}$ is the maximum of all $n_{Cot_m}^+(n)$ and represents the serial number of the last sampling point of the $m^{th}$ original frequency-lowered signal frame phase-matched with the sampling point corresponding to the phase reference sampling point number, and the sampling point is applied as the initial sampling point of the $(m+1)^{th}$ original frequency-lowered signal frame.

By contrast, if the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, i.e., the formula (5) is not satisfied, the processing unit 102 applies the second count value corresponding to the sampling point of the $m^{th}$ original frequency-lowered signal frame corresponding to the phase reference sampling point number as the reference value and applies the last-sampled sampling point of the $m^{th}$ original frequency-lowered signal frame where the second count value is equal to the reference value as the last sampling point of the $m^{th}$ original frequency-lowered signal frame, which can be represented by the following formulas (8) and (9):

$$n_{Cot_m}^-(n) = \begin{cases} n, & Cot_m^-(n) = Cot_m^-(n_{Cot_{m-1}} - N + 1) \\ 0, & \text{else} \end{cases} \quad (8)$$

$$n_{Cot_m} = \text{Max}\{n_{Cot_m}^-(n)\} \quad (9)$$

It can be derived from the formulas (8) and (9) that if the second count value $n_{Cot_m}^-(n)$ of the $m^{th}$ original frequency-lowered signal frame corresponding to the sampling point with the serial number n is equal to the first count value of the $m^{th}$ original frequency-lowered signal frame corresponding to the phase reference sampling point number, $n_{Cot_m}^-(n)$ is equal to the serial number n; if not, $n_{Cot_m}^-(n)$ is equal to 0. $n_{Cot_m}$ is the maximum of all $n_{Cot_m}^-(n)$ and represents the serial number of the last sampling point of the $m^{th}$ original frequency-lowered signal frame phase-matched with the sampling point corresponding to the phase reference sampling point number, and the sampling point is applied as the initial sampling point of the $(m+1)^{th}$ original frequency-lowered signal frame.

For instance, it is assumed that each of the original frequency-lowered signal frames WL1-WL4 shown in FIG.

2 includes 201 sampling points (with the serial numbers 0, 1, 2, . . . , and 200). The first count value $Cot_2^+(88)$ of the original frequency-lowered signal frame WL2 corresponding to the phase reference sampling point number (88) corresponding to the middle sampling point of the renovating frequency-lowered signal frame WL2' is less than or equal to the second count value $Cot_2^-(88)$ of the original frequency-lowered signal frame WL2 corresponding to the phase reference sampling point number corresponding to the middle sampling point of the renovating frequency-lowered signal frame WL2', and the first count value $Cot_1^+(88)$ of the original frequency-lowered signal frame WL2 corresponding to the middle sampling point of the original frequency-lowered signal frame WL2 (i.e., the sampling point of the original frequency-lowered signal frame WL2 numbered as 88) is 18.

Figure 3:
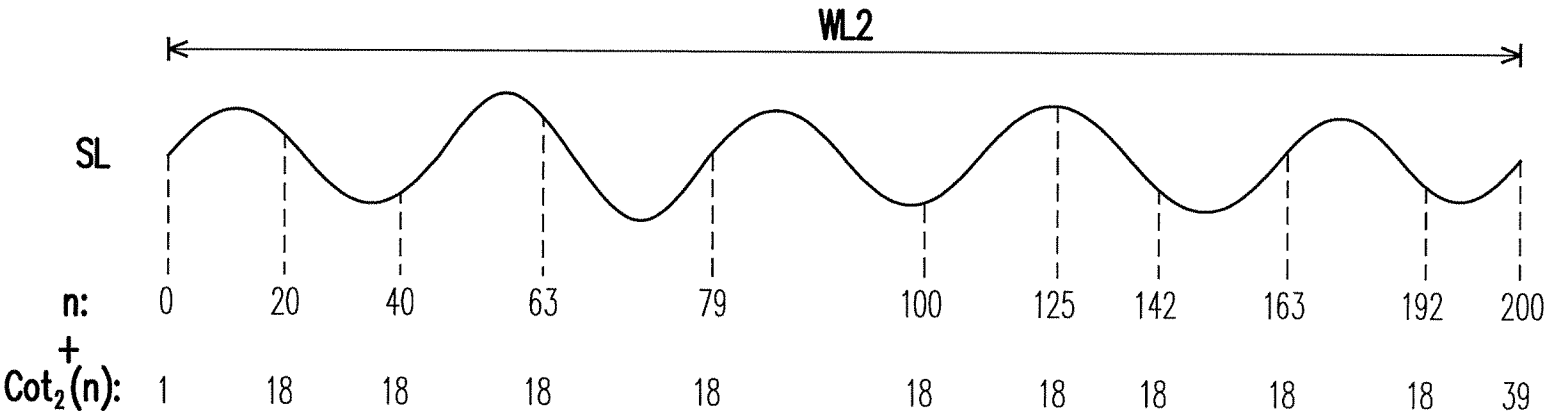
FIG. 3 is a schematic diagram illustrating an original frequency-lowered signal frame WL2 according to an embodiment of the invention.

To obtain the initial sampling point of the renovating frequency-lowered signal frame WL3', the processing unit 102 can count the serial number of the corresponding sampling point of the original frequency-lowered signal frame WL2 while the first count value $Cot_2^+(n)$ is equal to 18. Since the first count value of the original frequency-lowered signal frame WL2 corresponding to the sampling point numbered as 88 is less than the corresponding second count value $Cot_2^-(88)$, the first count value $Cot_2^+(88)$ is applied as the reference value. As shown by the schematic diagram illustrating the original frequency-lowered signal frame WL2 in FIG. 3, in the embodiment depicted in FIG. 3, the serial numbers of the sampling points where the first count value $Cot_2^+(n)$ of the original frequency-lowered signal frame WL2 is equal to 18 (i.e., the value of $n_{Cot_2}^+(n)$ that is not equal to 0) includes the serial numbers 20, 40, 63, 79, . . . , 100, 125, 142, 163, and 192. Here, the sampling point with the serial number 192 is the last-sampled sampling point among the sampling points of the original frequency-lowered signal frame WL2 where the first count value $Cot_2^+(n)$ is equal to the reference value (i.e., 18), and thus $n_{Cot_2}$ is equal to 192. The processing unit 102 may then apply the sampling point with the serial number 192 as the initial sampling point of the renovating frequency-lowered signal frame WL3' and apply 201 consecutive sampling points starting from the sampling point with the serial number 192 of the original frequency-lowered signal frame WL2 as the sampling points of the renovating frequency-lowered signal frame WL3'. As shown in FIG. 2, the renovating frequency-lowered signal frame WL3' includes the sampling points with the serial numbers from 192 to 200 of the original frequency-lowered signal frame WL2 and the sampling points with the serial number 192 and the prior numbers. Here, the serial number 92 of the original frequency-lowered signal frame WL3 (which is the serial number of the sampling point of the original frequency-lowered signal frame WL3 corresponding to the middle sampling point of the renovating frequency-lowered signal frame WL3') may be applied as the phase reference sampling point number which serve as a reference for searching an initial sampling point of the renovating frequency-lowered signal frame WL4'. The initial sampling point of the renovating frequency-lowered signal frame WL4' may also be obtained in a similar manner, which is not further described below.

It should be mentioned that the original frequency-lowered signal frame WL1 is the first original frequency-lowered signal frame, and thus the sampling points of the renovating frequency-lowered signal frame WL1' are included in the original frequency-lowered signal frame WL1, and the phase reference sampling point number of the original frequency-lowered signal frame WL1 corresponding to the middle sampling point of the renovating frequency-lowered signal frame WL1' is 100. In the present embodiment, the serial number of the last sampling point of the original frequency-lowered signal frame WL1 phase-matched with the middle sampling point of the original frequency-lowered signal frame WL1 is 188, which should however not be construed as a limitation to the invention. The method for obtaining the last sampling point (with the serial number 188) is similar to that applied in the foregoing embodiments, and people having ordinary skill in the art should be able to derive the way to implement the invention from the teachings provided in the foregoing embodiment. Hence, no further description is provided hereinafter.

After adjusting the sampling points of each of the original frequency-lowered signal frames and obtaining the corresponding renovating frequency-lowered signal frames, the processing unit 102 may perform a 50%-mixing and stacking action on the adjacent renovating frequency-lowered signal frames to generate an overlapping voice signal. Since the middle sampling point of each renovating frequency-lowered signal frame is phase-matched with the initial sampling point of the next renovating frequency-lowered signal frame, the issue of signal distortion caused by phase mismatch while the signal frames are overlapped can be resolved to a great extent. Besides, in some embodiments, after the renovating frequency-lowered signal frames corresponding to the original frequency-lowered signal frames are obtained, the frequency-lowered signal may be multiplied by a Hamming window to enhance continuity between the right-end and the left-end of the renovating frequency-lowered signal. As shown in FIG. 2, after a frequency-lowered signal SL' including the renovating frequency-lowered signal frames WL1' to WL4' is multiplied by the Hamming window, a frequency-lowered signal SH including renovating frequency-lowered signal frames WH1 to WH4 may be obtained, and an overlapping voice signal SO may be obtained by mixing and stacking the renovating frequency-lowered signal frames WH1 to WH4.

Figure 4:
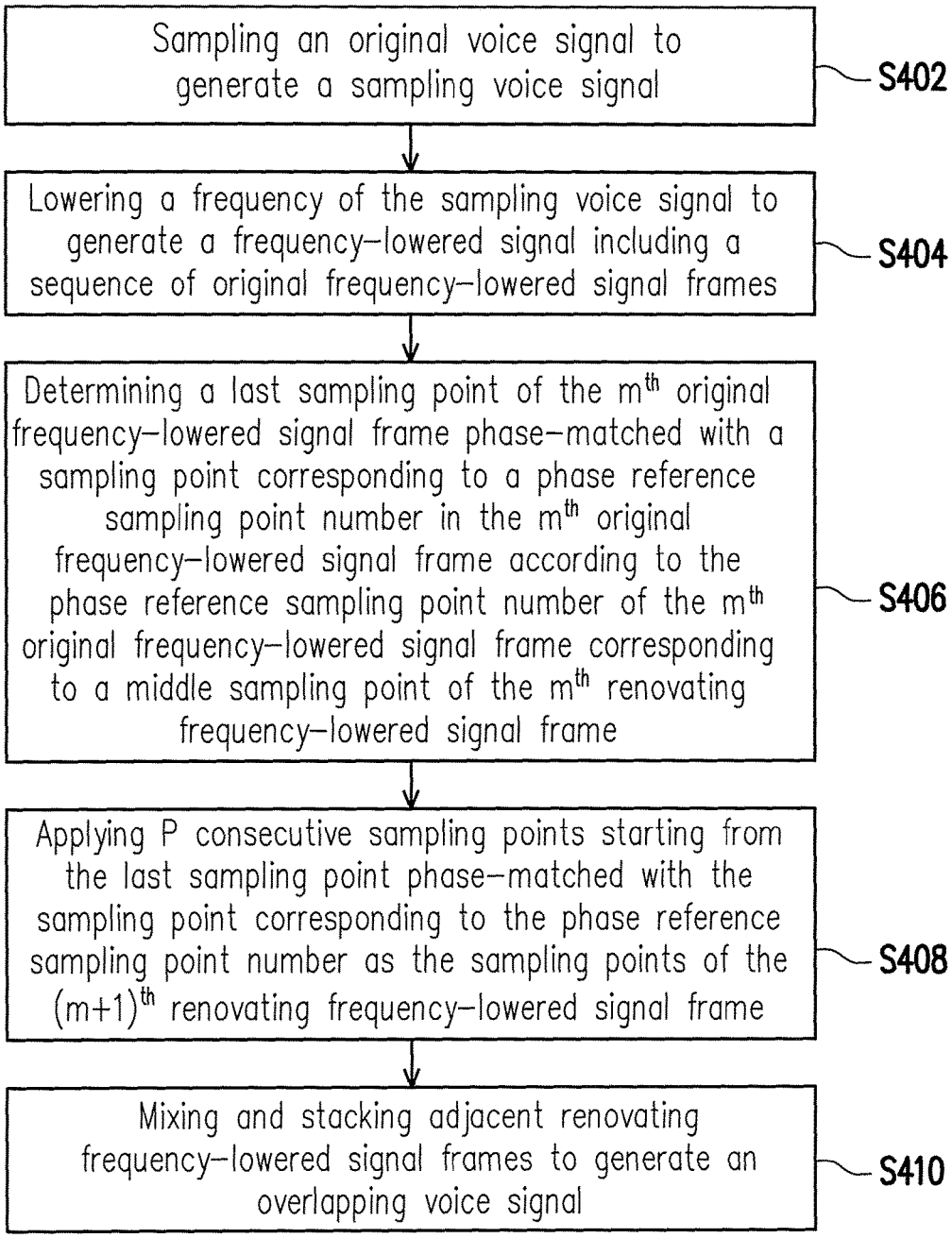
FIG. 4 is a schematic flowchart illustrating a voice signal processing method according to an embodiment of the invention.

FIG. 4 is a schematic flowchart illustrating a voice signal processing method according to an embodiment of the invention. With reference to FIG. 4 and in view of the foregoing embodiments, a voice signal processing method of said voice signal processing apparatus may include following steps. An original voice signal is sampled to generate a sampling voice signal (step S402). A frequency of the sampling voice signal is lowered to generate a frequency-lowered signal including a sequence of original frequency-lowered signal frames (step S404). Here, each of the original frequency-lowered signal frames includes p sampling points, and p is a positive integer. The last sampling point of the $m^{th}$ original frequency-lowered signal frame is determined according to a phase reference sampling point number of the $m^{th}$ original frequency-lowered signal frame. Here, the phase reference sampling point number corresponds to a middle sampling point of an $m^{th}$ renovating frequency-lowered signal frame, the last sampling point is phase-matched with a sampling point corresponding to the phase reference sampling point number in the $m^{th}$ original frequency-lowered signal frame (step S406), and m is a positive integer greater than 1. P consecutive sampling points starting from the last sampling point phase-matched with the sampling point corresponding to the phase reference sampling point number are applied as the sampling points of the $(m+1)^{th}$ renovating frequency-lowered signal frame (step S408). Adjacent renovating frequency-lowered signal frames are mixed and stacked to generate an overlapping voice signal (step S410). Each of two adjacent renovating frequency-lowered signal frames of the renovating frequency-lowered signal frames includes a 50% overlapping section, for instance.

Figure 5:
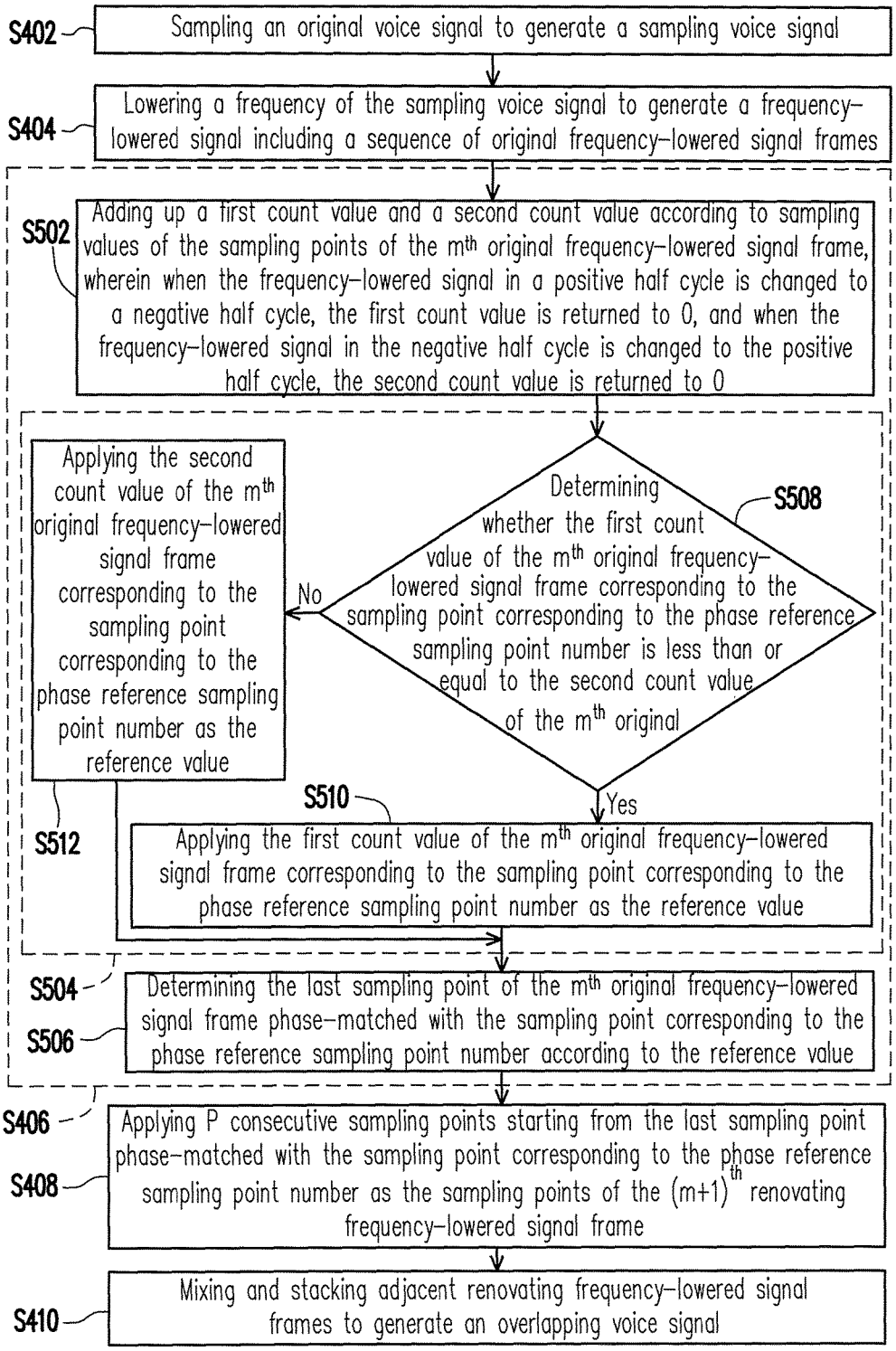
FIG. 5 is a schematic flowchart illustrating a voice signal processing method according to another embodiment of the invention.

FIG. 5 is a schematic flowchart illustrating a voice signal processing method according to another embodiment of the invention. Specifically, the step S406 shown in FIG. 4 may include steps S502-S506 according to the present embodiment. That is, a first count value and a second count value are added up according to sampling values of the sampling points of the $m^{th}$ original frequency-lowered signal frame. When the frequency-lowered signal in a positive half cycle is changed to a negative half cycle, the first count value is returned to 0, and when the frequency-lowered signal in the negative half cycle is changed to the positive half cycle, the second count value is returned to 0 (step S502). The first count value or the second count value corresponding to the sampling point of the $m^{th}$ original frequency-lowered signal frame corresponding to the phase reference sampling point number is applied as a reference value (step S504), and the last sampling point of the $m^{th}$ original frequency-lowered signal frame phase-matched with the sampling point corresponding to the phase reference sampling point number is determined according to the reference value (step S506). To be more specific, in step S504, whether the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number is determined (step S508). If the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, the first count value of the $m^{th}$ original frequency-lowered signal frame corresponding to the sampling point corresponding to the phase reference sampling point number is applied as the reference value (step S510). On this condition, in step S506, the last-sampled sampling point of the sampling points of the $m^{th}$ original frequency-lowered signal frame where the first count value is equal to the reference value can be applied as the last sampling point of the $m^{th}$ original frequency-lowered signal frame phase-matched to the sampling point corresponding to the phase reference sampling point number. If the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, the second count value of the $m^{th}$ original frequency-lowered signal frame corresponding to the sampling point corresponding to the phase reference sampling point number is applied as the reference value (step S512). On this condition, in step S506, the last-sampled sampling point of the sampling points of the $m^{th}$ original frequency-lowered signal frame where the second count value is equal to the reference value can be applied as the last sampling point of the $m^{th}$ original frequency-lowered signal frame phase-matched to the sampling point corresponding to the phase reference sampling point number.

To sum up, the last sampling point of the $m^{th}$ original frequency-lowered signal frame phase-matched with the sampling point corresponding to the phase reference sampling point number is determined according to the phase reference sampling point number of the $m^{th}$ original frequency-lowered signal frame corresponding to the middle sampling point of the $m^{th}$ renovating frequency-lowered signal frame. The P consecutive sampling points starting from the last sampling point phase-matched with the sampling point corresponding to the phase reference sampling point number is applied as the sampling points of the $(m+1)^{th}$ renovating frequency-lowered signal frame, such that the issue of signal distortion caused by overlapped signal frames with phase mismatch can be effectively resolved.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A voice signal processing apparatus comprising:

a sampling circuit configured to sample an original voice signal to generate a sampling voice signal;

a processor coupled to the sampling circuit and configured to:

lower a frequency of the sampling voice signal to generate a frequency-lowered signal including a sequence of original frequency-lowered signal frames, wherein each of the original frequency-lowered signal frames comprises p sampling points;

adjust the sampling points of the original frequency-lowered signal frames to obtain renovating frequency-lowered signal frames; and mix and stack adjacent renovating frequency-lowered signal frames of the renovating frequency-lowered signal frames to generate and output an overlapping voice signal, wherein the processor determines a last sampling point of an $m^{th}$ original frequency-lowered signal frame of the original frequency-lowered signal frames phase-matched with the sampling point corresponding to a phase reference sampling point number according to the phase reference sampling point number of the $m^{th}$ original frequency-lowered signal frame corresponding to a middle sampling point of an $m^{th}$ renovating frequency-lowered signal frame of the renovating frequency-lowered signal frames, wherein the processor sets p consecutive sampling points starting from the last sampling point phase-matched with the sampling point corresponding to the phase reference sampling point number as the sampling points of an $(m+1)^{th}$ renovating frequency-lowered signal frame of the renovating frequency-lowered signal frames, and wherein the phase reference sampling point number is a serial number of the sampling point of the $m^{th}$ original frequency-lowered signal frame corresponding to the middle sampling point of the $m^{th}$ renovating frequency-lowered signal frame, p is a positive integer, and m is a positive integer greater than 1.

2. The voice signal processing apparatus of claim 1, wherein each of two adjacent renovating frequency-lowered signal frames of the renovating frequency-lowered signal frames comprises a 50% overlapping section.

3. The voice signal processing apparatus of claim 2, wherein the processor further adds up a first count value and a second count value according to sampling values of the sampling points of the $m^{th}$ original frequency-lowered signal frame, when the frequency-lowered signal in a positive half cycle is changed to a negative half cycle, the processor returns the first count value to 0, when the frequency-lowered signal in the negative half cycle is changed to the positive half cycle, the processor returns the second count value to 0, the processor sets the first count value or the second count value corresponding to the sampling point of the $m^{th}$ original frequency-lowered signal frame corresponding to the phase reference sampling point number as a reference value, and the processor determines the last sampling point of the $m^{th}$ original frequency-lowered signal frame phase-matched with the sampling point corresponding to the phase reference sampling point number according to the reference value.

4. The voice signal processing apparatus of claim 3, wherein the processor further determines whether the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, if the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, the processor sets the first count value of the $m^{th}$ original frequency-lowered signal frame corresponding to the sampling point corresponding to the phase reference sampling point number as the reference value and sets a last-sampled sampling point of the sampling points of the $m^{th}$ original frequency-lowered signal frame where the first count value is equal to the reference value as the last sampling point of the $m^{th}$ original frequency-lowered signal frame phase-matched with the sampling point corresponding to the phase reference sampling point number, if the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, the processor sets the second count value of the $m^{th}$ original frequency-lowered signal frame corresponding to the sampling point corresponding to the phase reference sampling point number as the reference value and sets the last-sampled sampling point of the sampling points of the $m^{th}$ original frequency-lowered signal frame where the second count value is equal to the reference value as the last sampling point of the $m^{th}$ original frequency-lowered signal frame phase-matched with the sampling point corresponding to the phase reference sampling point number.

5. The voice signal processing apparatus of claim 1, wherein the processor further multiplies the frequency-lowered signal by a Hamming window.

6. A voice signal processing method, applicable to a voice signal processing apparatus having a sampling circuit and a processor, comprising the following steps:

sampling an original voice signal by the sampling circuit to generate a sampling voice signal;

lowering a frequency of the sampling voice signal by the processor to generate a frequency-lowered signal including a sequence of original frequency-lowered signal frames, wherein each of the original frequency-lowered signal frames comprises p sampling points, and p is a positive integer;

adjusting the sampling points of the original frequency-lowered signal frames by the processor to obtain renovating frequency-lowered signal frames comprising:

determining a last sampling point of an $m^{th}$ original frequency-lowered signal frame of the original frequency-lowered signal frames by the processor according to a phase reference sampling point number of the $m^{th}$ original frequency-lowered signal frame, the phase reference sampling point number corresponding to a middle sampling point of an $m^{th}$ renovating frequency-lowered signal frame of the renovating frequency-lowered signal frames, the last sampling point being phase-matched with a sampling point corresponding to the phase reference sampling point number in the $m^{th}$ original frequency-lowered signal frame, wherein the phase reference sampling point number is a serial number of the sampling point of the $m^{th}$ original frequency-lowered signal frame corresponding to the middle sampling point of the $m^{th}$ renovating frequency-lowered signal frame, and m is a positive integer greater than 1; and setting p consecutive sampling points starting from the last sampling point phase-matched with the sampling point corresponding to the phase reference sampling point number as the sampling points of an $(m+1)^{th}$ renovating frequency-lowered signal frame of the renovating frequency-lowered signal frames by the processor; and mixing and stacking adjacent renovating frequency-lowered signal frames of the renovating frequency-lowered signal frames by the processor to generate and output an overlapping voice signal.

7. The voice signal processing method of claim 6, wherein each of two adjacent renovating frequency-lowered signal frames comprises a 50% overlapping section.

8. The voice signal processing method of claim 7, wherein the step of determining the last sampling point of the $m^{th}$ original frequency-lowered signal frame phase-matched with the sampling point corresponding to the phase reference sampling point number by the processor according to the phase reference sampling point corresponding to the middle sampling point number of the $m^{th}$ renovating frequency-lowered signal frame comprises:

adding up a first count value and a second count value by the processor according to sampling values of the sampling points of the $m^{th}$ original frequency-lowered signal frame, wherein when the frequency-lowered signal in a positive half cycle is changed to a negative half cycle, returning the first count value to 0, and when the frequency-lowered signal in the negative half cycle is changed to the positive half cycle, returning the second count value to 0;

setting the first count value or the second count value corresponding to the sampling point of the $m^{th}$ original frequency-lowered signal frame corresponding to the phase reference sampling point number as a reference value by the processor; and determining the last sampling point of the $m^{th}$ original frequency-lowered signal frame phase-matched with the sampling point corresponding to the phase reference sampling point number by the processor according to the reference value.

9. The voice signal processing method of claim 8, wherein the step of setting the first count value or the second count value corresponding to the sampling point of the $m^{th}$ original frequency-lowered signal frame corresponding to the phase reference sampling point number as the reference value by the processor comprises:

determining whether the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number by the processor;

if the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, setting the first count value corresponding to the sampling point of the $m^{th}$ original frequency-lowered signal frame corresponding to the phase reference sampling point number as a reference value by the processor; and if the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, setting the second count value corresponding to the sampling point of the $m^{th}$ original frequency-lowered signal frame corresponding to the phase reference sampling point number as a reference value by the processor.

10. The voice signal processing method of claim 9, wherein if the first count value of the $m^{th}$ original frequency-lowered signal frame corresponding to the sampling point corresponding to the phase reference sampling point number is less than or equal to the second count value of the $m^{th}$ original frequency-lowered signal frame corresponding to the sampling point corresponding to the phase reference sampling point number, the method comprises:

setting a last-sampled sampling point of the sampling points of the $m^{th}$ original frequency-lowered signal frame where the first count value is equal to the reference value as the last sampling point of the $m^{th}$ original frequency-lowered signal frame phase-matched with the sampling point corresponding to the phase reference sampling point number by the processor.

11. The voice signal processing method of claim 9, wherein if the first count value of the $m^{th}$ original frequency-lowered signal frame corresponding to the sampling point corresponding to the phase reference sampling point number is greater than the second count value of the $m^{th}$ original frequency-lowered signal frame corresponding to the sampling point corresponding to the phase reference sampling point number, the method comprises:

setting a last-sampled sampling point of the sampling points of the $m^{th}$ original frequency-lowered signal frame where the second count value is equal to the reference value as the last sampling point of the $m^{th}$ original frequency-lowered signal frame phase-matched with the sampling point corresponding to the phase reference sampling point number by the processor.

12. The voice signal processing method of claim 9, comprising:

multiplying the frequency-lowered signal by the processor by using a Hamming window.

* * * * *